US006665879B2

(12) United States Patent
VandenBerg

(10) Patent No.: US 6,665,879 B2
(45) Date of Patent: Dec. 23, 2003

(54) WEIGHTED INSERT

(76) Inventor: Nancy Lynn VandenBerg, 4646 Wishing Well Ct., Portage, MI (US) 49024

( * ) Notice: Subject to any disclaimer, the term of this patent is extended or adjusted under 35 U.S.C. 154(b) by 0 days.

(21) Appl. No.: 10/141,568

(22) Filed: May 8, 2002

(65) Prior Publication Data

US 2003/0208832 A1 Nov. 13, 2003

(51) Int. Cl.[7] ..... A41D 1/04
(52) U.S. Cl. ..... 2/102; 482/105
(58) Field of Search ..... 2/102, 69, 115, 2/105, 93, 94, 2.5, 81, 253; 482/105, 139

(56) References Cited

U.S. PATENT DOCUMENTS

| | | | | |
|---|---|---|---|---|
| 4,268,917 | A | | 5/1981 | Massey |
| 4,344,620 | A | | 8/1982 | Debski |
| 4,382,302 | A | | 5/1983 | Watson |
| 4,394,012 | A | | 7/1983 | Egbert et al. |
| D278,840 | S | | 5/1985 | Winston |
| 4,602,387 | A | | 7/1986 | Zakrzewski |
| 4,658,442 | A | | 4/1987 | Tomlinson et al. |
| 4,989,267 | A | | 2/1991 | Watson |
| 5,144,694 | A | | 9/1992 | Conrad Da oud et al. |
| D340,794 | S | | 11/1993 | Winston |
| 5,465,423 | A | * | 11/1995 | Taylor-Varney ..... 2/462 |
| 5,526,535 | A | | 6/1996 | Dobrzenski |
| 5,555,562 | A | | 9/1996 | Holt et al. |
| D390,338 | S | | 2/1998 | Plasco |
| 5,768,706 | A | * | 6/1998 | Griffith et al. ..... 2/102 |
| 5,810,699 | A | | 9/1998 | Nadeau |
| 5,937,441 | A | | 8/1999 | Raines |
| 5,943,700 | A | | 8/1999 | Hammer et al. |
| 6,081,924 | A | | 7/2000 | Ott |
| 6,209,135 | B1 | | 4/2001 | Irvin |
| 6,283,897 | B1 | | 9/2001 | Patton |

OTHER PUBLICATIONS

Nancy L. Vandenberg, *The Use of a Weighted Vest to Increase On–Task Behavior in Children with Attention Difficulties*, AJOT, Vol 55, No 6, Nov./Dec. 2001, pp 621–628.

Doreen Fertel–Daly, Gary Bedell & Jim Hinojosa, *Effects of a Weighted Vest on Attention to Task and Self–Stimulatory Behaviors in Preschoolers with Pervasive Developmemtal Disorders*, AJOT, Vol 55, No 6, Nov./Dec. 2001, pp 629–640.

* cited by examiner

*Primary Examiner*—Tejash Patel
(74) *Attorney, Agent, or Firm*—John M. Naber; Nancy A. Vashaw

(57) ABSTRACT

A durable weighted vest insert to produce a calming effect in users. The insert has a plurality of sealed compartments having weights in an anterior and posterior portion. Weight distribution is configured to provide a uniform and even pressure predominately over the upper muscles of the back and high on the pectoral muscles (i.e., an anterior and posterior shoulder girdle) when placed on a user and can be determined as a percentage of a user's body weight. The insert has mechanical fasteners such as pressure sensitive fastening materials, zippers, buttons, ties or hooks on an exposed surface. The invention can also include a vest having an interior surface comprising opposing mechanical fasteners placed corresponding to the fasteners of the insert whereby the insert can be incorporated and concealed within the vest.

19 Claims, 2 Drawing Sheets

WEIGHTED INSERT

FIELD OF THE INVENTION

The present invention relates generally to the field of weighted vests, and in particular to a weighted vest with a plurality of evenly distributed weight enclosures that provides an even pressure across the anterior and posterior shoulder girdle of a person or animal to produce a calming effect.

BACKGROUND OF INVENTION

Weighted vests are known in the art and have primarily been developed to improve an athlete's strength and cardiovascular condition during exercise. For example, U.S. Pat. No. 4,268,917 to Massey describes a variably weighted vest with a plurality of deep and large pockets to add up to 30 pounds of weight. Most of the prior art weighted vests are designed for temporary use such as during exercise. Therefore, concerns about comfort, durability, appearance or the number of users are not a concern. Weighted vests designed for exercise also generally teach to keep the weights low on the vest. If the weights are high on the body, the athlete's balance is affected since the body's center of mass is raised as the distribution of weights raises. See generally, U.S. Pat. No. 4,989,267 to Watson. Unfortunately, low placement of the weight frequently causes poor and uneven weight distribution since the weights essentially "hang" from the user. This can cause shoulder discomfort as the weight pulls down on the vest rather than applying direct pressure to the muscles in the shoulder girdle area.

Weight placed about the muscles of the shoulder girdle of an individual or animal is known to cause a calming effect and is known as proprioception or deep touch-pressure effect. This calming effect can be an important goal in teaching children with attention deficit hyperactivity disorder ("ADHD") and others with attention difficulties such as autism or pervasive developmental disorders. See VandenBerg, N. L.; Vol. 55, No. 6, AJOT 621–628, *The Use of Weighted Vest to Increase On-Task Behavior in Children with Attention Difficulties* and Fertel-Daly, D., Bedell, G., & Hinojosa, J. (2001). Vol. 55, No. 6, AJOT, 629–640, *Effects of a Weighted Vest on Attention to Task and Self-Stimulatory Behaviors in Preschoolers With Pervasive Developmental Disorders*. A weighted vest can, for example, calm children who have problems moderating their own level of arousal, preventing them from paying attention or attending to tasks. A weighted vest can allow them to focus attention through the physiological effects of sustained pressure.

Unfortunately, application of a typical weighted vest known in the art for this task yields minimal results. The vests are: bulky and unattractive in, for example, a schoolroom setting; they do not apply direct pressure to the shoulder girdle area, but only add weight by hanging and pulling down on areas of the body from which the fabric is supported, causing discomfort; and they do not meet the needs of a school setting to keep items clean and durable. Further, the vest should be comfortable for prolonged use, including sitting. The weights should be fixed in place to avoid removal of the weight for use as a projectile or to prevent being played with. It is typical for ADHD children to frequently fidget with available objects.

Therefore, there is a desire and a need to develop a device that avoids the shortcomings in the art and could be incorporated into standard clothing. This device could accommodate a variety of ADHD applications and is simple in design to allow for a durable, concealed, attractive, and economical product available for use in most educational settings, or within a child's every day environmental settings.

SUMMARY OF THE INVENTION

Accordingly, the present invention provides a weighted vest insert. Features of the present invention include an insert, that when worn, would have uniformly placed weights predominately over the upper muscles of the back and high on the pectoral muscles (i.e., a shoulder girdle) of a user. The insert can be made from a durable material that is easy to clean and delouse such as vinyl. The insert can be comfortable and can be concealed by incorporation into various garments such as a denim jacket so that it does not look too juvenile or therapeutic. Once incorporated into a vest, the insert imposes mild deep pressure that can produce a calming effect that may help a child/adult stay purposely on-task or otherwise attentive to the task at hand.

Specifically, the invention has two layers of a durable material, such as vinyl, forming anterior and posterior portions fastened together at their periphery to define an interior space and shaped to define a neck portion; a plurality of mechanical fasteners attached to an exposed side; and a plurality of sealed compartments having weights within the interior space of predetermined size, weight, shape, and distribution, wherein a uniform and even pressure is applied predominately over the upper muscles of the back and high on the pectoral muscles (i.e., across the anterior and posterior shoulder girdle) of a user.

The mechanical fasteners can be pressure sensitive fastening materials, zippers, buttons, ties or hooks. The vest insert weight can be configured as a percentage of a user's body weight, such in the range between 3 to 5 percent. The weights should have rounded edges and placed within the vest insert sealed compartments to minimize noise and movement of the weights.

The invention can also include a vest having an interior surface comprising opposing mechanical fasteners placed corresponding to the fasteners of the insert, whereby the weighted vest insert can be incorporated and concealed within the vest.

Other features and advantages of the present invention will become more apparent to persons having ordinary skill in the art to which the present invention pertains from the following description taken in conjunction with the accompanying figures.

BRIEF DESCRIPTION OF THE FIGURES

The foregoing advantages and features, as well as other advantages and features, will become apparent with reference to the description and figures below, in which like numerals represent like elements and in which.

DETAILED DESCRIPTION OF THE INVENTION

The present invention generally involves the field of weighted vests. The present invention provides a weighted vest insert with a plurality of evenly distributed weight enclosures that provide an even pressure predominately over the upper muscles of the back and high on the pectoral muscles (i.e., the anterior and posterior shoulder girdle) of a user. This type of weight distribution can provide a proprioception or deep touch-pressure effect, which produces a physiologically calming effect. By way of example, this type of effect can be useful in teaching children with attention deficit hyperactivity disorder (ADHD) and others with attention difficulties such as autism or pervasive developmental disorders. The insert can be configured to be inserted and concealed within a vest so as not to make a user self-conscious or conspicuous to their peers. The insert can be easily removed for laundering the vest.

Figure 1:
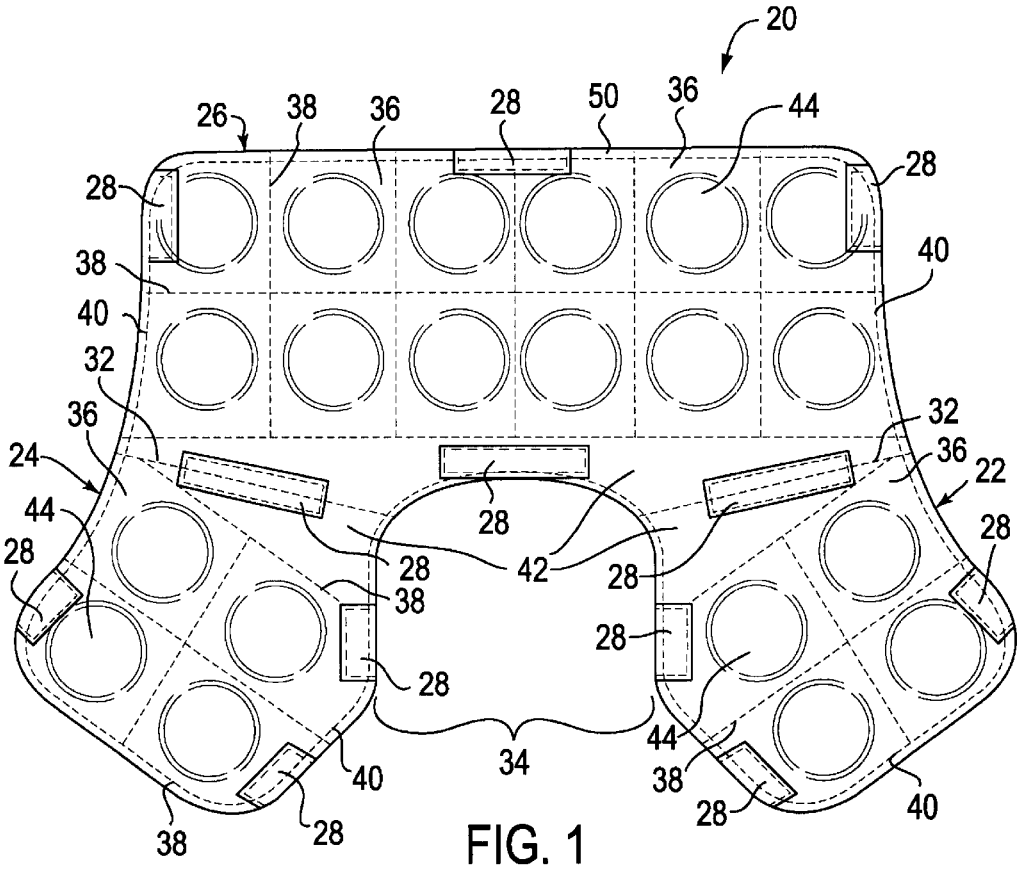
FIG. 1 is a pattern view showing the present invention.

Referring more specifically to the drawings, a weighted vest insert ("insert") pattern using the present invention is generally indicated on FIG. 1 at 20. The insert 20 can include an anterior portion having, for example, first and second front panels 22 and 24 respectively and a posterior portion having, for example, a rear panel 26. The panels 22 and 24 each have a front edge 23 and the rear panel includes a back edge 27. The panels 22, 24, and 26 can have two layers of material such as vinyl or other durable material that is easy to clean or delouse. The two layers can be attached together at their periphery, as shown at 40, to define an interior space 42 within each panel. It is noted that in an alternate embodiment, the pattern would allow for a single panel with anterior and posterior portions and a single defined interior space.

The insert 20 can also have a plurality of mechanical fasteners 28 stitched or otherwise attached to it on an exposed side 50 (i.e., the side of the insert 20 that would not be resting on the user). The fasteners 28 can include a variety of fastening devices known in the art such as zippers, buttons, hooks, ties, or a pressure sensitive fastening material commonly known under the trademark of VELCRO.

The front panels 22 and 24 can be attached to the rear panel 26 by sewing them together as at 32 along their adjoining top portions. Once the panels are attached they define a neck portion as shown at 34.

The pattern of the present invention illustrated in FIG. 1 also includes a plurality of sealed compartments 36 within the interior space 42. The compartments 36 can be sealed in a variety of manners known in the art such as sewing as shown at 38. The compartment seals 38 define the compartments 36. The compartments 36 can be uniformly and evenly spaced.

The compartments 36 can be filled with weights 44 of various predetermined size, shape, distribution, and weight prior to being sealed. Factors used to make this determination include a desire to provide a uniform and even pressure applied across the anterior and posterior shoulder girdle of the user.

Once sealed, the weights 44 are fixed into place and difficult for the user to access. It is desirable to configure the weights 44 and sealed compartments 36 to minimize weight 44 movement within the sealed compartment 36. As shown in the embodiment of FIG. 1, the weight can be a flat round disk made of a dense material such as metal. For example, a large common washer found in any hardware store could be used. The weights 44 need to equal a predetermined total desired weight usually based as a percentage of the user's overall body weight. This percentage can include a range between 3 percent to 5 percent of the user's body weight.

In an alternate embodiment, the weight could be a dense or viscous "gel" pack such as a silicon gel found in some contemporary bicycle seats. This "gel" pack embodiment could also contain metal "shot" such as steel shot evenly dispersed throughout the gel and can also be used in the single panel embodiment described above.

Figure 2:
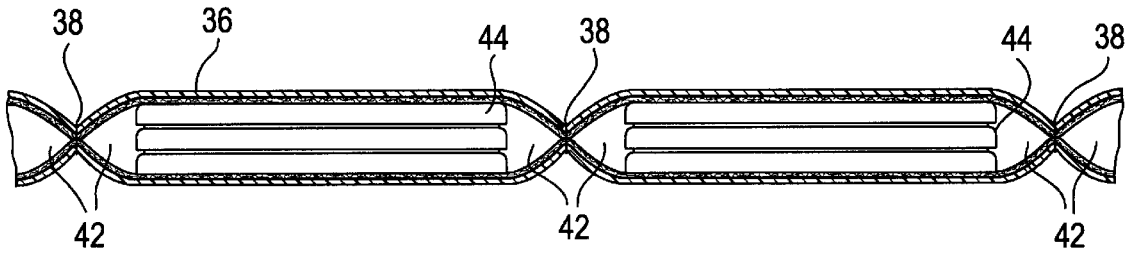
FIG. 2 is a side view of the sealed compartments of the present invention.

FIG. 2 shows a side view illustration of some of the sealed compartments 36. As shown in this example, the weights 44 include three round metal disks in each sealed compartment 36. Use of weights 44 with rounded edges are desired to minimize sharp edges that could lead to excessive wear of the insert 20 or discomfort to the user. If a plurality of weights 44 is contained within the same sealed compartment 36, the weights can be covered in a sound deadening material or secured together, such as by gluing.

Figure 3:
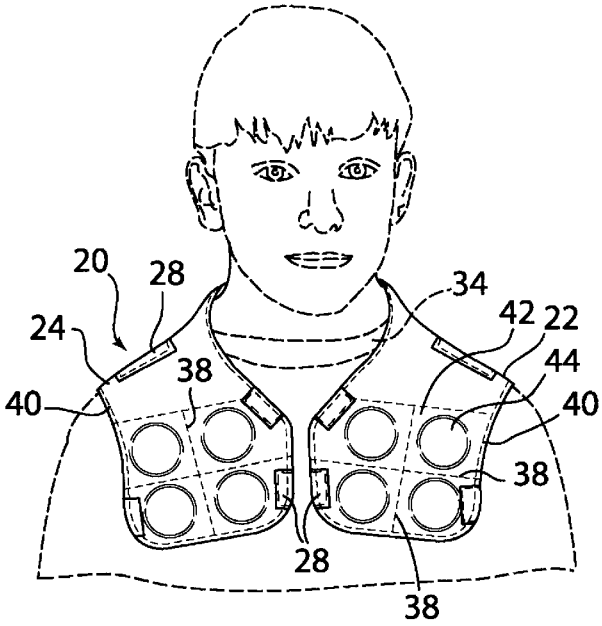
FIG. 3 is a perspective view of a user wearing just the insert of the present invention.

FIG. 3 illustrates the insert 20 placed on a user to demonstrate where it would be positioned. As shown, the neck portion 34 closes up close to the user's neck to minimize slippage or movement of the insert 20 from side to side. The insert 20 is held in place on the user by the weight of the insert against the user's body. In the embodiment shown in the figures, the front edge 23 of the front panels 22 and 24 extend to a position approximately at the bust line of the user, and the back edge 27 is positioned at a location above the middle of the user's back. However, it is to be understood that the front and rear edge may extend a shorter or longer distance.

Figure 5:
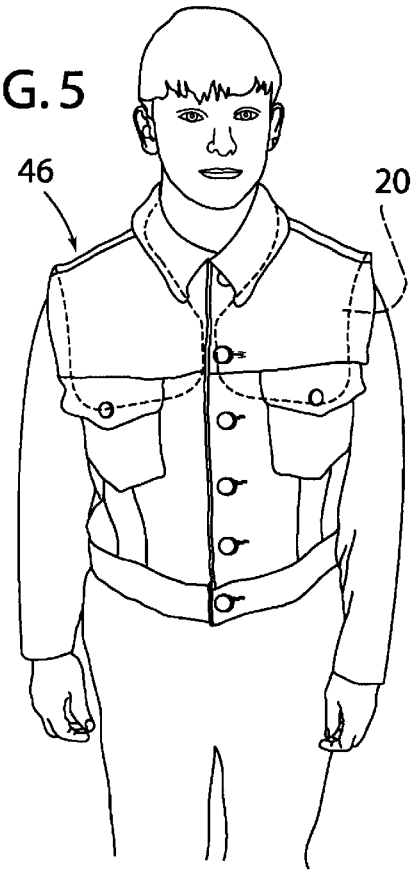
FIG. 5 is a perspective view of a user wearing a vest with the present invention inserted.

When inserted into a vest 46, as shown in FIG. 5, the weights are evenly spaced resting entirely across the upper back, shoulder to shoulder, and across the upper chest, shoulder to shoulder (shoulder-girdle area) of the user. The insert 20 lays flat on the user and can be incorporated into a variety of vests known in the art, such as a denim type vest 46, as shown in FIG. 4 so that it would not be noticeable when in place.

Figure 4:
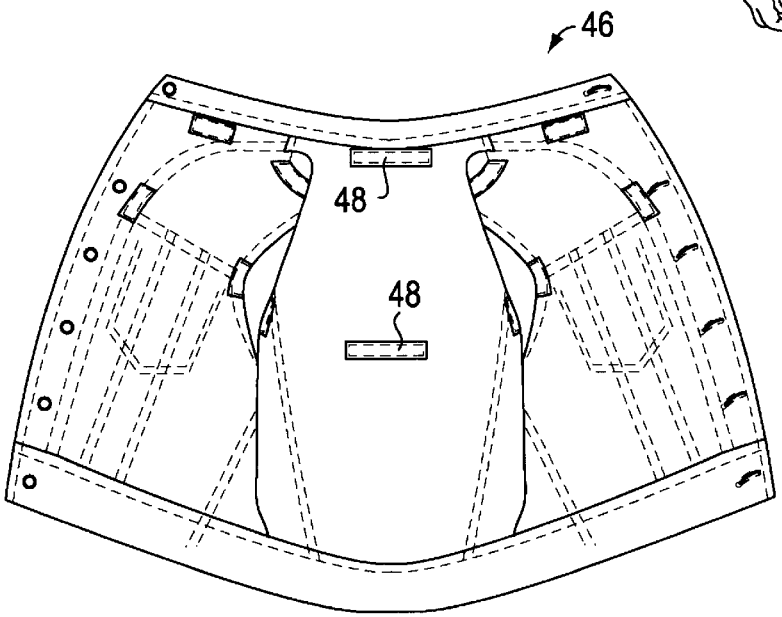
FIG. 4 is a view of a possible corresponding vest interior that the present invention can be inserted into.

FIG. 4 illustrates the denim vest 46 in an open position showing a set of opposing mechanical fasteners 48 placed corresponding to the fasteners 28 of the insert 20. For example, this can be accomplished using the opposing side of the pressure sensitive fastening material commonly known under the trademark of VELCRO. If buttons were used, buttonholes or tabs would be added. Opposing zippers, hooks or ties could also be attached for those types of mechanical fasteners on the insert 20.

Once the insert 20 is incorporated, the vest 46 can be closed at the neck to evenly place the weights 44 in the anterior panels across the user's chest. As stated previously, pressure from the weights 44 can produce a desired calming effect needed to, for example, help children increase their focus or attention to task. The present invention does not require the use of vest 46 to achieve the desired effect. Therefore, in some insert configurations, the vest need not be present.

The insert 20 results in an attractive or concealed appearance that will encourage its use. Thus, the vest insert can allow a therapeutic use with a non-therapeutic appearance.

Having described the subject matter of the present invention, it should be apparent that many substitutions, modifications, and variations of the invention are possible in light of the above teachings. It is therefore to be understood the invention as taught and described herein is only to be limited to the extent of the breadth and scope of the appended claims.

I claim:

1. A weighted insert, comprising:

two layers of a durable material fastened together at their periphery to define an interior space and forming anterior and posterior portions of the insert, said anterior portion including a first and second panel and said posterior portion includes a rear panel, said panels defining a neck portion;

said first and second panels each having a front edge and further configured to extend on opposite sides and forward of a user's neck such that said front edge is at a location substantially above the user's waistline and said first and second panels contact the user's pectoral muscles, and said rear Panel includes a back edge and extends downwardly on a user's back such that said back edge is at a location substantially above the user's waistline, said rear panel configured to contact the user's upper back muscles; and said interior space including a plurality of sealed compartments having weights of predetermined size, weight, shape, and distribution, wherein a uniform and even pressure is applied to the upper muscles of the back and high on the pectoral muscles (anterior and posterior shoulder girdle) when placed on a the user and wherein said weights are configured to provide a calming and therapeutic effect to the user.

2. The insert of claim 1, wherein said durable material is vinyl.

3. The insert of claim 1, wherein the predetermined weight is determined as a percentage of a user's body weight.

4. The insert of claim 3, wherein the predetermined weight is 3 percent of the user's body weight.

5. The insert of claim 3, wherein the predetermined weight is 5 percent of the users body weight.

6. The insert of claim 1, wherein said weights have rounded edges.

7. The insert of claim 1, wherein said weights are configured to minimize noise and movement of said weights within said sealed compartments.

8. A system to apply pressure across an anterior and posterior shoulder girdle of a user, comprising:

a weighted insert, comprising two layers of a durable material fastened together at their periphery to define an interior space and forming anterior and posterior portions, said anterior portion and said posterior portion configured to define a neck portion;

a plurality of mechanical fasteners attached to an exposed side of the insert; and said interior space including a plurality of sealed compartments having weights of predetermined size, weight, shape, and distribution, wherein uniform and even pressure is applied across said anterior and posterior shoulder girdle of the user; and a garment having an interior surface comprising opposing mechanical fasteners placed corresponding to said fasteners on said exposed side of the insert, wherein said weighted insert is configured to be connected to and concealed within said garment.

9. The system of claim 8, wherein said mechanical fastener is a pressure sensitive fastening material.

10. The system of claim 8, wherein said mechanical fastener is a zipper.

11. The system of claim 8, wherein said mechanical fastener is a button.

12. The system of claim 8, wherein the predetermined weight is determined as a percentage of a user's body weight.

13. The system of claim 8, wherein the predetermined weight is 3 percent of the user's body weight.

14. The system of claim 8, wherein the predetermined weight is 5 percent of the user's body weight.

15. The system of claim 8, wherein said weights include a gel material.

16. A weighted insert for use with a garment, comprising:

a first and second layer of durable material fastened together at their periphery to define an interior space and forming anterior and posterior portions;

said first and second layers configured to define a neck portion;

a plurality of mechanical fasteners attached to an outer surface of the insert to permit attachment to the inner surface of a garment to conceal the insert during use;

a plurality of weights dispersed within said interior space of a predetermined weight, wherein a uniform and even pressure is applied to the upper back muscles and high on the pectoral muscles when placed on the user, and wherein said weights are configured to provide a calming and therapeutic effect to the user.

17. The weighted insert of claim 16, wherein said plurality of weights include a gel material.

18. The weighted insert of claim 17, further comprising steel shot evenly dispersed throughout said gel.

19. The weighted insert of claim 16, wherein said gel is a silicon gel.

* * * * *